United States Patent [19]

Plata et al.

[11] Patent Number: 4,934,445

[45] Date of Patent: Jun. 19, 1990

[54] PROCESS AND DEVICE FOR COOLING AN OBJECT

[75] Inventors: Miroslaw Plata, Sion; Kurt Buxmann, Sierre, both of Switzerland

[73] Assignee: Swiss Aluminum Ltd., Chippis, Switzerland

[21] Appl. No.: 349,318

[22] Filed: May 8, 1989

[30] Foreign Application Priority Data

May 19, 1983 [CH] Switzerland ..... 1910/88

[51] Int. Cl.[5] ..... B05B 1/28; B22D 11/124

[52] U.S. Cl. ..... 164/486; 164/444; 239/290; 239/424

[58] Field of Search ..... 164/444, 486; 239/290, 239/294, 424

[56] References Cited

U.S. PATENT DOCUMENTS

| | | | |
|---|---|---|---|
| 3,302,399 | 2/1967 | Tini et al. | 239/552 |
| 3,675,852 | 7/1972 | Hajduk et al. | 239/424 |
| 3,693,352 | 9/1972 | Hinze et al. | 62/64 |
| 4,019,560 | 4/1977 | Gruner et al. | 164/444 |
| 4,424,855 | 1/1984 | Tsubakihara et al. | 164/444 |
| 4,531,675 | 7/1985 | Muck | 239/290 |
| 4,592,510 | 6/1986 | Grothe | 164/444 |

FOREIGN PATENT DOCUMENTS

| | | |
|---|---|---|
| 2256790 | 8/1975 | France . |
| 59-130664 | 7/1984 | Japan . |
| 2163674 | 3/1986 | United Kingdom . |

*Primary Examiner*—Richard K. Seidel
*Assistant Examiner*—Rex E. Pelto
*Attorney, Agent, or Firm*—Bachman & LaPointe

[57] ABSTRACT

The process is such that a gas/fluid mixture is sprayed in the form of a mist onto the surface of the object to be cooled. To that end a stream of fluid is passed through the nozzle outlet and atomized to a mist of droplet size <100 μm, and after emerging from the nozzle is impacted by gas streams at an angle (x) of 0°-90° to the nozzle axis (x) to accelerate and deflect the droplets. The intensities of the gas stream can be regulated independently of one another. The process is suitable for cooling conventionally or electromagnetically cast ingots, rolled products and extruded products of metal, in particular aluminum. A suitable device for carrying out the process is comprised essentially of a part (1) featuring a nozzle (3) that supplies and aligns a fluid, and bores (5*a, b*) that supply gas, part 1 fitting into a counter part (2) such that gas alignment channels (7*a, b*) are formed.

14 Claims, 1 Drawing Sheet

PROCESS AND DEVICE FOR COOLING AN OBJECT

BACKGROUND OF THE INVENTION

The invention relates to a process for cooling an object by spraying a gas/liquid mixture in the form of a mist onto the surface of the object using at least one jetting nozzle and relates also to a device for carrying out the process.

Atomized air/water mixtures to cool extrusion billets have the advantage over water alone that there is a smaller risk of explosion with the former, this because the air/water mist striking the surface can be adjusted such that the water evaporates almost completely.

Known spraying systems are based on the principle of the Venturi pipe where the air/water mixture is already formed inside the jetting nozzle. Such Venturi nozzles have the disadvantage that the amount of air required to form a water mist is extremely great. Furthermore, the intensity of cooling at the area jetted by the mist varies locally to a very large degree, this because the region coinciding with the axis of the jet is cooled much stronger than the peripheral regions.

SUMMARY OF THE INVENTION

In view of the above it is the object of the invention to develop a process and a device of the kind as described above start by means of which the cooling action can be improved, at the same time reducing the amount of gas.

The object is achieved by way of a process according to the invention in which a stream of fluid is jetted through the nozzle outlet to form a mist comprising droplets $<100$ $\mu$m, and after emerging from the nozzle is impacted with a gas stream at an angle of 0 to 90% to the nozzle axis, this to accelerate and deflect the droplets.

BRIEF DESCRIPTION OF THE DRAWINGS

Further advantages, features and details of the invention are revealed in the following consideration of a preferred exemplified embodiment and with the aid of the drawings wherein.

DETAILED DESCRIPTION

Figure 1:
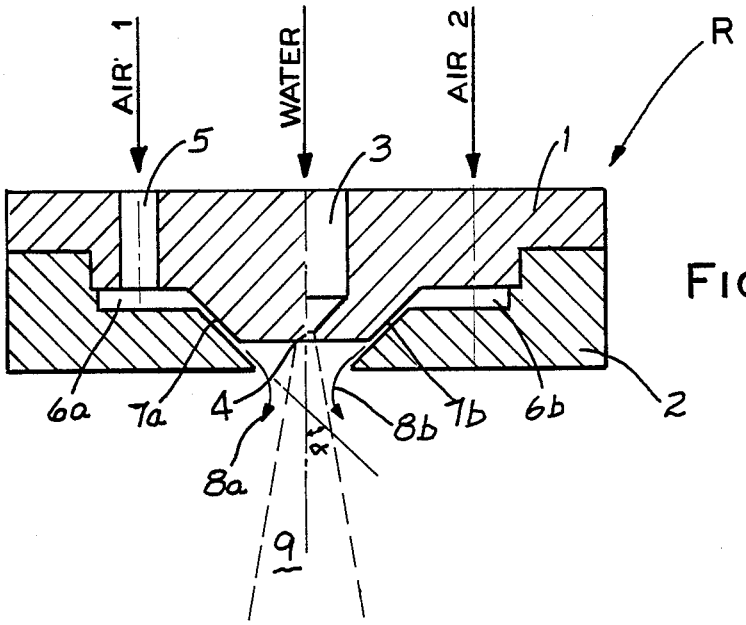
FIG. 1 shows a schematic cross-section through a device according to the invention.
Figure 2:
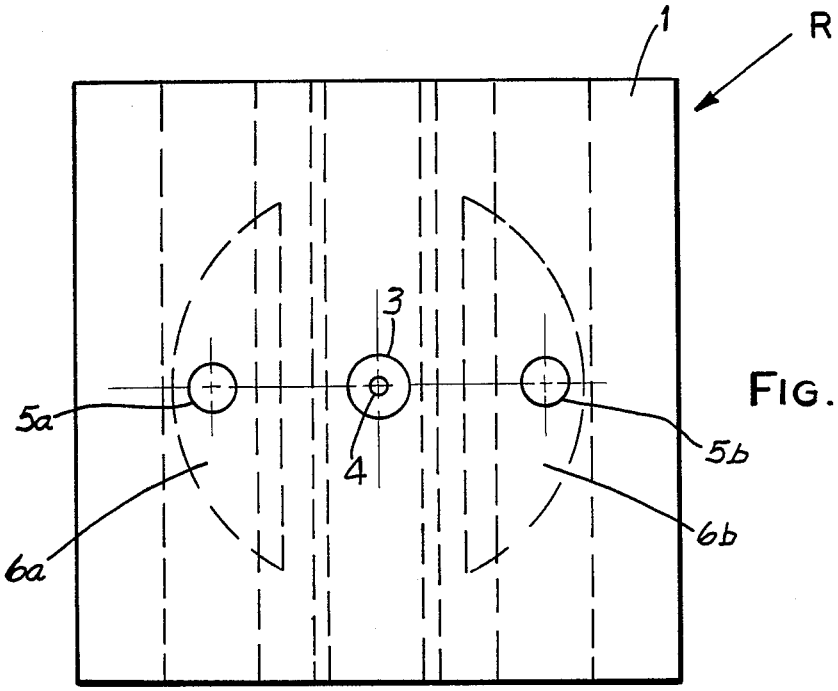
FIG. 2 shows a plan view of the device shown in FIG. 1.

In the process according to the invention the amount of gas flowing in the system can be reduced to a small fraction of that flowing in a gas/fluid mixture process based on the Venturi nozzle. Surprisingly it has also been found that jetting of the fluid stream and accelerating the droplets after the nozzle using the process according to the invention produces a uniform distribution of cooling intensity over the area struck by the mist i.e. on the surface of the object to be cooled.

In a preferred manner of operating the process the intensity of each gas stream is regulated independent of other. This makes it possible to alter, over a wide range, the direction of the conical, finely divided stream of fluid formed after the nozzle opening. For a given arrangement of nozzles this makes it possible to make fine adjustment to the cooling of the object that is to be cooled.

Any cooling medium of choice can be employed; in most cases, however, water is preferred.

As gas phase there is the possibility of using air; other gases such as nitrogen or argon, however, can also be employed.

The process is particularly suitable for cooling conventionally or electromagnetically cast ingots, also rolled and extruded products made of metal, in particular aluminum.

In the case of extruded products with parts of different thickness it is particularly desirable to adjust the cooling intensity in order to avoid subsequent straightening operations. Using a previously calculated arrangement of a plurality of nozzles and final fine adjustment of the cooling intensity by setting the gas streams at different strengths, it is possible to achieve the production of extrusions that are free of distortion.

The process is also suitable for cooling hot surfaces by complete evaporation of the coolant, in which case the cooling intensity lies preferably in the range 500–3000 $W/m^2$° K.

A further possible application of the process according to the invention is such that the item to be cooled (e.g. extruded section, rolled strip, rotating roll or cylinder) is led past a fixed nozzle system; the cooling effect is achieved by complete evaporation of the coolant, and the heat transfer number of the item to be cooled follows a previously determined curve.

The device according to the invention is characterized by way of a nozzle that supplies and directs a fluid and, in the region of the nozzle outlet, channels that supply and direct gas situated at an angle of 0°–90° to the nozzle axis.

In the simplest case two such gas channels are provided, symmetrically arranged and concentric to the nozzle axis, it being possible to feed gas through said channels at different independent pressures.

The drawings show a device R for cooling an object which comprises a part 1 which has a water supply nozzle 3 with nozzle outlet 4 and is penetrated by two diametrically opposite bores 5*a,b* for the supply of gas. In the drawing the pipe-lines for supplying water and air are shown schematically. Part 1 fits into a counterpart 2 such that both parts combine to form ring shaped spaces 6*a,b* leading to gas alignment channels 7*a,b* for gas streams 8*a,b*. The gas channels 7*a,b* form an angle $\alpha$, for example of 45°, with the nozzle axis x.

By applying different pressures to the bores 5*a,b* the direction of the conical, atomized stream of water 9 can be varied over a wide range.

What is claimed is:

1. Process for cooling an object by spraying a gas-liquid mixture in the form of a mist onto the surface of the object by means of a nozzle which comprises: providing a nozzle having a nozzle outlet and an axis; passing a liquid stream through the nozzle outlet thereby forming a mist spray of droplet size $<100$ $\mu$m; and impacting said formed mist spray downstream of said nozzle outlet after the mist spray emerges from the nozzle outlet by at least two streams of gas at an angle of 0°–90° to the nozzle axis to accelerate and deflect the droplets.

2. Process according to claim 1 including the step of regulating the intensities of the gas streams independently of one another.

3. Process according to claim 1 wherein said gas is air.

4. Process according to claim 1 wherein said liquid is water.

5. Process according to claim 1 including the step of cooling cast ingots selected from the group consisting of conventionally cast ingots and electromagnetically cast ingots with said impacted mist spray.

6. Process according to claim 1 including the step of cooling rolled metal products with said impacted mist spray.

7. Process according to claim 1 including the step of cooling extruded metal products with said impacted mist spray.

8. Process according to claim 1 including the step of cooling aluminum with said impacted mist spray.

9. Process according to claim 1 including the step of cooling hot surfaces with said impacted mist spray with complete evaporation of the coolant.

10. Process according to claim 9 employing cooling intensities of 500–3000 $W/m^{2\circ}$ K.

11. Process according to claim 1 wherein said nozzle comprises a fixed nozzle system and including the step of cooling objects with said impacted mist spray that are led past said fixed nozzle system, the cooling effect taking place with complete evaporation of the coolant, wherein the heat transfer number of the object to be cooled follows a given previously determined curve.

12. Device for cooling an object by spraying a gas-liquid mixture in the form of a mist onto the surface of the object by means of a nozzle which comprises: a nozzle having a nozzle outlet and an axis; means for passing a liquid stream through the nozzle outlet so as to form a mist spray of droplet size $<100$ $\mu$m; and at least two independent gas feeding and alignment means arranged at an angle of 0°–90° to the axis of the nozzle for impacting said formed mist spray downstream of said nozzle outlet by streams of gas emerging from said channels at said angle to accelerate and deflect the droplets.

13. Device according to claim 12 wherein said device comprises a part including said nozzle that supplies and aligns said liquid stream, and bores that supply gas, and a counterpart fitting said part therein so that said gas alignment channels are formed.

14. Device according to claim 12 wherein the gas alignment channels are arranged symmetrically and concentric with respect to the nozzle axis.

* * * * *